US005904353A

United States Patent [19]

Aldridge

[11] Patent Number: 5,904,353

[45] Date of Patent: May 18, 1999

[54] STACK OF CARDS REPRESENTING A PAIR OF DICE AND GAME

[76] Inventor: Chester P. Aldridge, 3 Circle Dr., Apt. B, Tiburon, Calif. 94920

[21] Appl. No.: 08/877,271

[22] Filed: Jun. 17, 1997

[51] Int. Cl.[6] ..... A63F 1/00

[52] U.S. Cl. ..... 273/292; 273/303; 273/306; D21/42; D21/43

[58] Field of Search ..... 273/303–306, 273/292; D21/42, 43

[56] References Cited

U.S. PATENT DOCUMENTS

| | | | |
|---|---|---|---|
| D. 59,761 | 11/1921 | McCarthy | D21/43 |
| D. 62,466 | 6/1923 | Bley | D21/43 |
| 143,703 | 10/1873 | Louineau . | |
| 854,547 | 5/1907 | Werner . | |
| 4,199,146 | 4/1980 | Dato | 273/249 |
| 4,355,812 | 10/1982 | McCullough | 273/248 |
| 4,359,227 | 11/1982 | Porciello | 273/268 |
| 4,443,012 | 4/1984 | Makovic et al. | 273/292 |
| 5,551,700 | 9/1996 | Druce et al. | 273/296 |

FOREIGN PATENT DOCUMENTS

| | | |
|---|---|---|
| 7627781 | 9/1976 | France . |
| 304440 | 12/1927 | United Kingdom . |
| 1532624 | 10/1974 | United Kingdom . |
| 2154148 | 9/1985 | United Kingdom . |

*Primary Examiner*—Benjamin H. Layno
*Attorney, Agent, or Firm*—Intellectual Property Law Group; Otto O. Lee

[57] ABSTRACT

A deck of thirty-six playing cards representing every roll combination of two six-sided dice. Each card displays the two dice on the face of each card in different color so as to distinguish every possible combination of the two dice. A corresponding game using this deck of cards for more than one players to achieve a winning suit of four cards of the same numerical total, containing the same dice, or of a specific orientation of high cards or low cards.

9 Claims, 3 Drawing Sheets

STACK OF CARDS REPRESENTING A PAIR OF DICE AND GAME

BACKGROUND

This invention relates generally to card games, and more particularly to card games with dice.

Conventional games are played by two types of game players, namely card players and dice players. Typically, skilled card players enjoy cards playing because they possess superior ability to memorize, or "count cards." Since the number of cards in a deck of playing cards is fixed, a card player who can memorize cards removed from the original deck will have the advantage of predicting the next upcoming cards from the remaining card deck by the process of elimination of counting cards.

On the other hand skilled dice players generally masters the calculation of probability. Since each roll of dice is completely separate from a previous or subsequent roll, the probability of each roll is exactly the same (i.e. one in six for a single dice, or one in thirty-six for a pair of dice). One cannot predict the probability of the rolls by eliminating previous rolls because each roll is independent of one another.

Conventional games do not have the special features offered by the combination of card and dice games. Therefore, it is desirable to have a dice game where skilled cards players with superior memory can combine the skill of card playing and counting with the skill of calculating probability of a dice game.

Furthermore, there is a need of a combination card and dice apparatus that may substitute the use of a pair of dice in most conventional games requiring the use of dice to determine probability. During travels on cars and trains, the vibration within the moving compartment frequently makes it difficult to play a game that requires a stable flat surface to throw a pair of dice. Especially in such environment, the throwing of dice is undesirable because dice easily bounces off the surface due to the movement and vibration. Therefore it is highly desirable to substitute dice throwing with cards drawing so that vibrations within such compartment will not affect the probability determination of the game. In addition, the use of cards will eliminate the percussive sound generated by the rolling of the dice on the surface. To some players, the repetitive percussive sound from the repeating roll of the dice is annoying and undesirable. Therefore, the use of cards will be preferable.

Additionally, card players may also elect to not recycle drawn cards back into the card deck, thereby allowing players with superior memory to eliminate those previously drawn cards in their probability calculation. This will provide additional challenge and excitement to allow a player to better predict the subsequent cards being drawn from the remaining card deck.

The general idea of a combination card and dice game is not novel. For e.g., U.S. Pat. No. 4,443,012 by Makovic et al. discloses a card game showing two dices that represent the numerical total of the two dice on each card. This game consists of sixty cards (six of each numerical total) and has no correlation with the probability of the occurrence of the roll of the dice. For example, the numerical total of six contains three combinations, namely, five and one, four and two, and three and three. All three combinations are put onto the same card. This game also requires the use of a pair of real dice, which is cumbersome and lack a major feature of the present invention of substituting the pair of dice completely. In addition, this game does not have the card containing the most common numerical combination of a pair of dice, namely, seven. Therefore the '012 patent does not satisfy the earlier identified needs.

Thus, there is a need for a game combining the skills of calculating the probability of a pair of dice roll and the memorization skills of counting cards to better predict the subsequent cards being drawn. In addition, it will also be highly desirable to have a combination card and dice game that substitute the use of a pair of dice because dice frequently bounce off the play surface during the roll, and eliminate the repetitive percussive noise from a dice roll.

SUMMARY

The present invention satisfies these needs. This invention comprises a deck of playing cards having thirty-six cards, each card of the deck having two opposing faces, wherein a first face represents a decorative design, wherein a second face contains two numbers of two colors, representing two dice respectively, and a numerical value that equals a value total of the two dice, such that each playing card represents each of the thirty-six mathematically possible roll combination of two different dice.

In a preferred embodiment, the deck of playing cards also includes a plurality (preferably two, but no more than six) of wild cards; such that a game player may substitute the wild card to achieve a winning suit.

In another preferred embodiment, the second face of the playing card contains pictures depicting two different dice, preferably of a three-dimensional depiction and of two different colors such that the player can get an authentic feel of seeing the two different dice.

In yet another preferred embodiment, the invention is a method of playing a card game with a plurality of players, comprising selection of a deck of playing cards comprising thirty-six cards, each card of the deck having two opposing faces, wherein a first face representing a decorative design, wherein a second face representing two dice, with different color so that each playing card corresponds to each mathematically possible roll combination of two different dice; selection of a random selection means such that a plurality of cards are dealt to a plurality of players in a random manner; selection of a winning suit comprising a certain combination of cards, such that a player with the cards matching the winning suit will win the card game.

In another preferred embodiment, the method of playing a card game as further comprises steps of continually replacing the cards by discarding and picking up cards by each player, passing the play to other players, with the play passed until one of the players achieve and reveal the winning suit.

In another embodiment, the method of playing a card game further comprises steps of each player being distributed with four cards, and that each player discards one of the four cards simultaneously so that other players may see the numerical value of each of the discarded cards, that a first player will choose to pick up any of the discarded cards and then choose to discard a card, then a second player will choose to pick up any of the discarded cards and then choose to discard one of the cards, such that these steps are repeated until one of the players achieve and reveal the winning suit.

Also preferably, each player may have an additional alternative to choose not to pick up the discarded cards, but draw a new card from the remaining card deck.

Therefore the present invention satisfies the long felt need of a having game combining the probability of dice and the memorization skills of counting cards.

DRAWINGS

These and other features, aspects, and advantages of the present invention will be better understood from the following drawings, description and appended claims, where:

DETAILED DESCRIPTION OF THE INVENTION

The following discussion describes in detail one embodiment of the invention and several variations of that embodiment. This discussion should not be construed, however, as limiting the invention to those particular embodiments. Practitioners skilled in the art will recognize numerous other embodiments as well. For a definition of the complete scope of the invention, the reader is directed to the appended claims.

Figure 1:
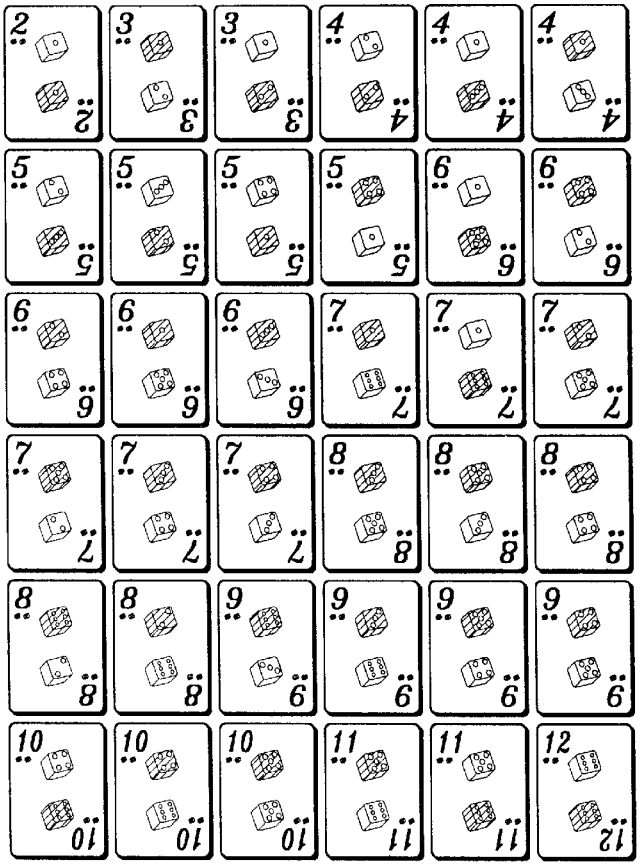
FIG. 1 is a schematic view of the thirty-six (36) cards disclosed in this invention.
Figure 2:
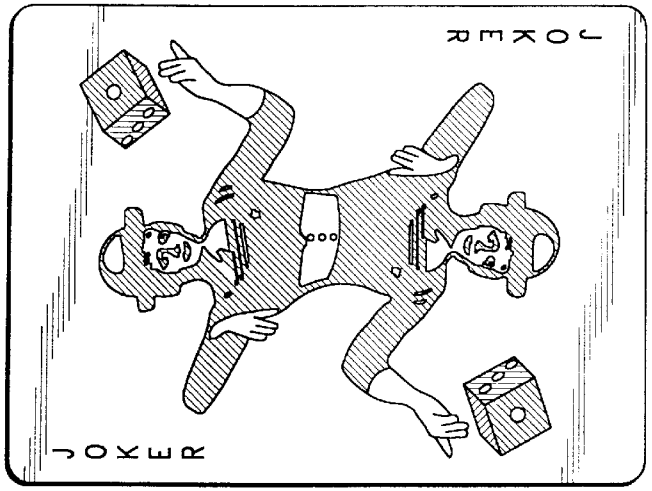
FIG. 2 is a pictorial view of a preferred embodiment of the wild cards disclosed in this invention.
Figure 3:
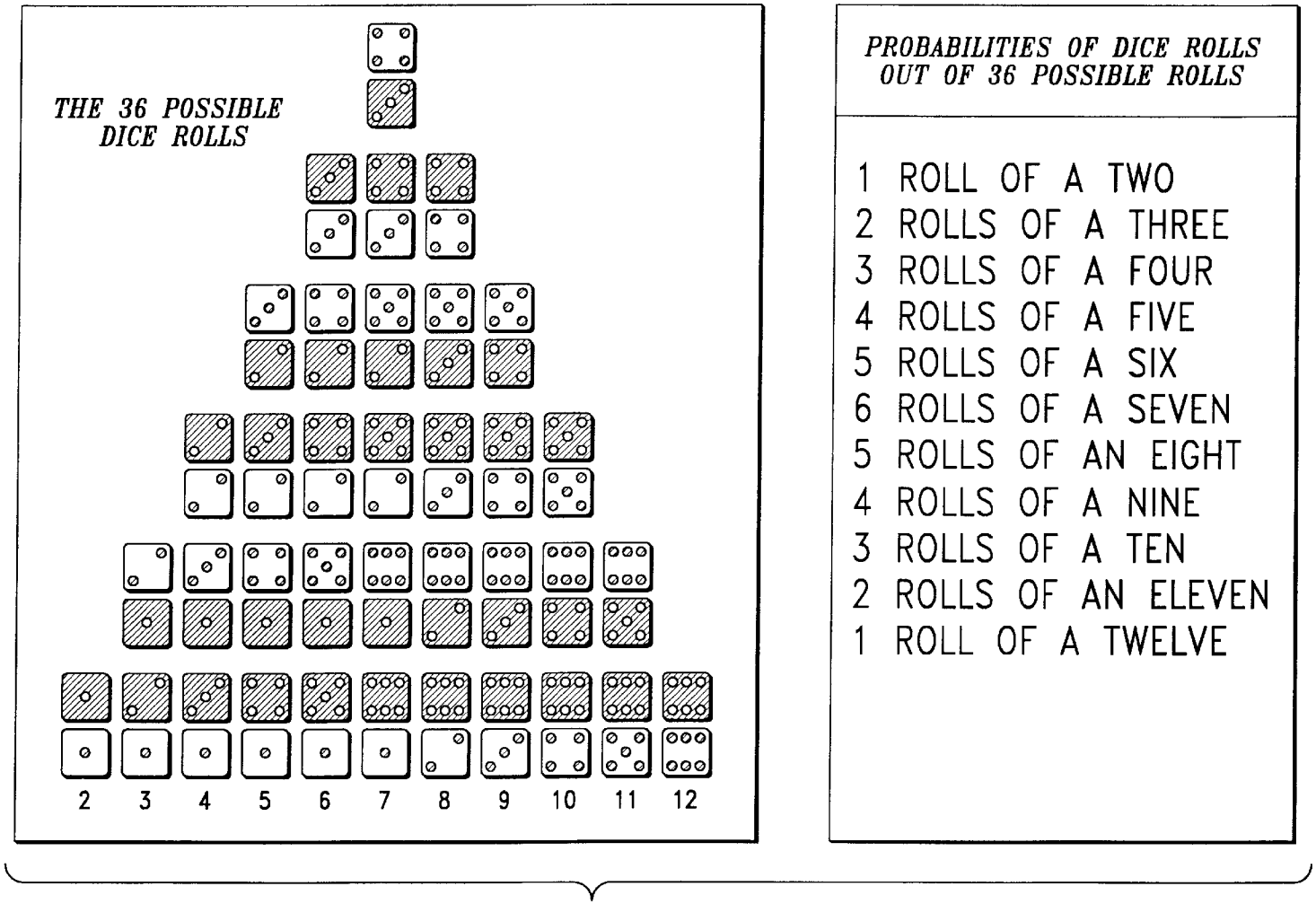
FIG. 3 is a schematic view of the thirty-six (36) possibilities for the roll of a pair of dice as disclosed in this invention.
Figure 4:
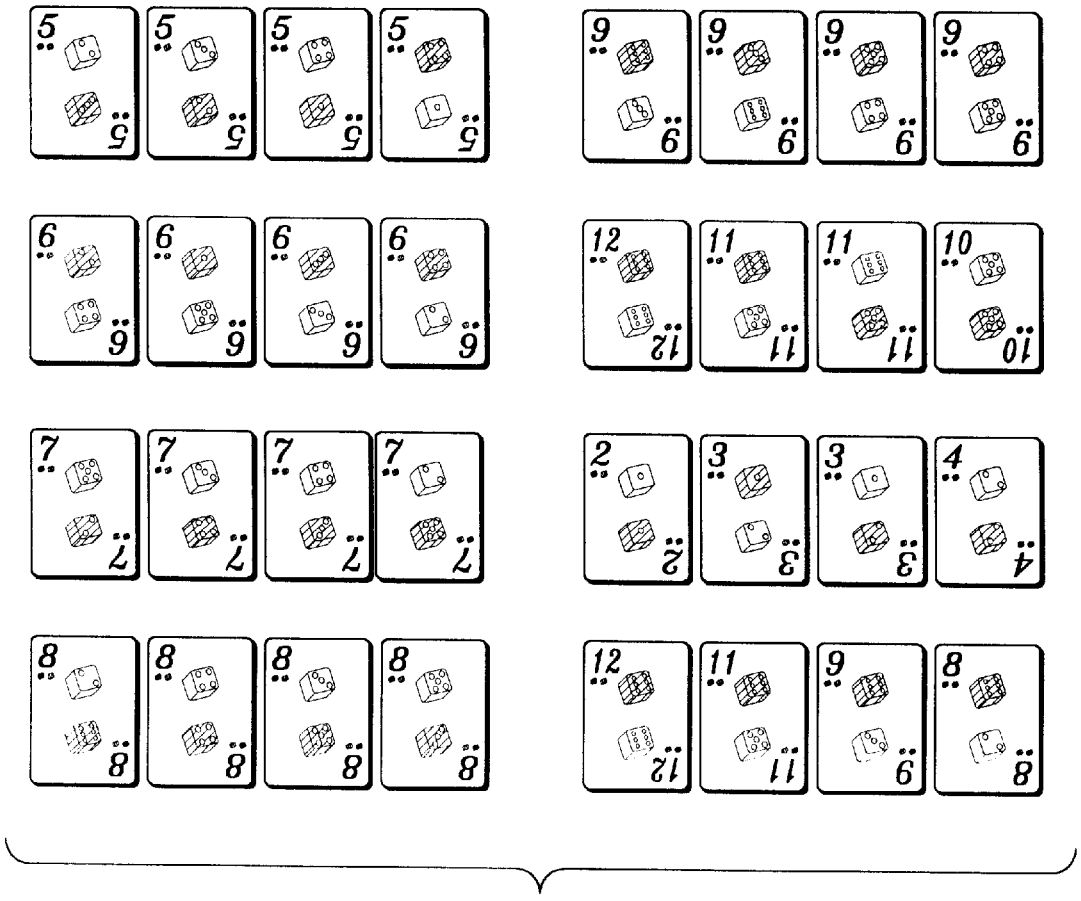
FIG. 4 is a schematic view of the various winning sets of a preferred embodiment of this invention.

The invention is a deck of playing cards representing every roll combination of two dice, preferably with at least thirty-six (36) cards. This invention combines the changing probability of playing cards with the constant possibility of the roll of a pair of dice. A three-dimensional representation of the roll of the pair of dice is printed on the face of each card, enabling the player to get the look of an actual pair of dice, as shown in FIG. 1. To further differentiate between the two dice, each dice is shown with different contrasting colors, e.g. black and white. This allows every combination of the two dice to be distinguishable (for e.g., there are two possibilities for the roll of three; namely, either one-two, or two-one. To distinguish these two different rolls, the card representing the one-two roll will have a white dice showing "one" and a black dice showing "two", and vice versa for the two-one roll.)

Players will determine the probability of a finite number of cards. For example, the odds of drawing a specific card (e.g. 2, a one-one roll for a pair of dice) within a deck of thirty-six cards, is one in thirty-six. However, if a player is holding three cards, while none of them is a "2", the odds of drawing the "2" card becomes only one in thirty-three. Of course, if all the cards are returned back to the deck and reshuffled, the probability of drawing a certain card will be the same as the random roll of a pair of dice, i.e. one in thirty-six.

In one preferred embodiment, the deck of thirty-six cards may be played by over two players, but preferably less than six. The object of the game is to achieve the winning suits to earn as many points as possible based on the following chart. Of course, the winning suit or award points assigned may be varied.

| WINNING SUIT | AWARD |
|---|---|
| Four Cards with the Number 5 | 25 points |
| Four Cards with the Number 9 | 25 points |
| Four Cards with the Number 6 | 20 points |
| Four Cards with the Number 8 | 20 points |
| Four Cards with the Number 7 | 15 points |

-continued

| WINNING SUIT | AWARD |
|---|---|
| Four Cards with pairs of doubles | 15 points |
| Four Highest Cards in deck (12,11,11,10) | 10 points |
| Four Lowest Cards in deck (2,3,3,4) | 10 points |
| Four Cards having one die of same die and color | 3 points |

Preferably, four cards are dealt to each player initially from a randomly shuffled deck of cards. The player will then choose to discard and replace the cards, one card at a time, to achieve one of the winning suits as listed above. The first player that displays a winning suit will win that game, and be awarded the corresponding points. Also preferably, the player with the most points after a sequence of games pre-determined by either exceeding a fixed numerical point, a fixed number of games, or a fixed time limit will be the ultimate winner.

Wild cards may also be added to the deck of cards, whereby each wild card may substitute whatever card the player desires in order to achieve a winning suit.

In one embodiment, the game will be played as follows:

For a game of two to five players, each player is first dealt with four cards faced down, counter-clockwise, one card at a time from a fully shuffled deck. Thereafter, each player picks up the four cards for their own review. Thereafter, all players will simultaneously select to discard one card, face up on the table. The first person being dealt the four cards will begin building a winning suit of four cards by either acquiring, or picking up any one of the face up cards discarded by the other three players, or draw a card from the remaining deck of cards. Then the first person will select one of the four cards to be discarded, facing up and be placed on top of the earlier discarded card by the first player. Note that once a discarded card is being covered by another discarded card, this covered card is "permanently discarded" and is no longer available to be picked up or acquired by any player. Then the second player (the player sitting immediately counter-clockwise to the first player) will choose to either pick up any one of the face up cards discarded by the other three players, or draw a card from the remaining deck of cards. This process of discarding and picking up cards will be repeated until one of the players achieves a winning suit and reveals the cards. The winning player will earn the pre-determined points corresponding to the winning suit. Thereafter, all the cards are collected and re-shuffled for random re-distribution. The game may end when a player reaches a total of fifty (50) points, or when the time reaches one hour. Or alternatively, the game may end when a predetermined number of hands (for e.g. twenty) are dealt.

In another preferred embodiment, the deck of cards also comprises a plurality of "wild cards", which a player may choose to substitute it with any of the cards necessary to build a winning suit. The number of wild cards shall not be too numerous to make the game unexciting or meaningless, it is recommended that the total number of wild cards added to the deck of cards be limited to approximately two, and no more than six.

What is claimed is:

1. A deck of playing cards comprising thirty-six cards, each card of the deck having two opposing faces, wherein a first face represents a decorative design, wherein a second face contains a first number having a first color, and a second number having a second color which is different from the first color, said first and second numbers, representing a resulting roll combination of two dice respectively, and a numerical value that equals a value total of the two dice;

each of said playing cards having a different combination of two numbers and two colors such that each playing card is distinguishably unique from every other playing card, and the playing cards represent each of the thirty-six mathematically possible roll combination of two different six-sided dice.

2. The deck of playing cards in claim 1, further comprising a second face that contains pictures depicting two different six-sided dice.

3. The deck of playing cards in claim 2, further comprising two three-dimensional pictures depicting two different six-sided dice of two different colors.

4. A method of playing a card game with a plurality of players, comprising selection of a deck of playing cards comprising thirty-six cards, each card of the deck having two opposing faces, wherein a first face representing a decorative design, wherein a second face representing two dice, with different color so that each playing card corresponds to each mathematically possible roll combination of two different dice;

selection of a random selection means such that a plurality of cards are dealt to a plurality of players in a random manner;

selection of a winning suit comprising a certain combination of cards, such that a player with the cards matching the winning suit will win the card game.

5. The method of playing a card game as set forth in claim 4, further comprising steps of continually discarding and picking up cards by each player, passing the play to other players after the discard and pick up sequence is completed, such that the steps are repeated until one of the players achieve and reveal the winning suit.

6. The method of playing a card game as set forth in claim 5, further comprising steps of each player being distributed with four cards, that each player discards one of the four cards simultaneously so that other players may see the numerical value of each of the discarded cards, that a first player will choose to pick up any of the discarded cards and then choose to discard a card, then a second player will choose to pick up any of the discarded cards and then choose to discard one of the cards;

such that the steps are repeated until one of the players achieve and reveal the winning suit.

7. The method of playing a card game as set forth in claim 6, further comprising steps of each player also being able to choose to not pick up the discarded cards and draw a card from the remaining card deck.

8. A deck of playing cards comprising thirty-six cards, each card of the deck having two opposing faces, wherein a first face represents a decorative design, wherein a second face contains a pictorial representation depicting a first six-sided dice having a first color and a second six-sided dice having a second color, said second color is different form the first color, and said first and second six-sided dice depicting a first and a second value respectively that represent a resulting roll combination of two six-sided dice, such that each playing card is distinguishably unique from every other playing card, and the playing cards represent each of the thirty-six mathematically possible roll combination of two different six-sided dice.

9. The deck of playing cards in claim 8, further comprising a numerical value that equals a value total of the two six-sided dice on the second face.

* * * * *